United States Patent [19]

Volat

[11] Patent Number: 4,867,430

[45] Date of Patent: Sep. 19, 1989

[54] DEVICE FOR UNSTACKING RELATIVELY FLAT OBJECTS SUCH AS LETTERS OR POSTAL PACKETS

[75] Inventor: Jean-Pierre Volat, Aix-en-Provence, France

[73] Assignee: Bertin & Cie, Plaisir, France

[21] Appl. No.: 200,520

[22] Filed: May 26, 1988

[30] Foreign Application Priority Data

May 27, 1987 [FR] France ..... 87 07527

[51] Int. Cl.[4] ..... B65H 5/00

[52] U.S. Cl. ..... 271/2; 271/6; 271/12; 271/13; 271/31.1; 271/225; 271/149; 271/150; 271/241

[58] Field of Search ..... 271/2, 5, 6, 11, 12, 271/13, 107, 108, 30.1, 31.1, 225, 272, 149, 150, 4, 10, 104, 241, 167; 221/211, 262; 414/113, 120, 121, 128, 330, 752

[56] References Cited

U.S. PATENT DOCUMENTS

| | | | |
|---|---|---|---|
| 3,146,902 | 9/1964 | Voelker | 271/2 X |
| 3,866,764 | 2/1975 | Leiser | 271/106 |
| 3,885,784 | 5/1975 | Sautton | 271/94 |
| 4,346,876 | 8/1982 | Guenther et al. | 271/11 |
| 4,701,094 | 10/1987 | Courjaret et al. | 271/11 X |
| 4,759,537 | 7/1988 | Illig et al. | 271/107 X |

FOREIGN PATENT DOCUMENTS

| | | | |
|---|---|---|---|
| 2249412 | 12/1973 | Fed. Rep. of Germany . | |
| 7848 | 1/1981 | Japan | 271/11 |
| 340838 | 10/1959 | Switzerland . | |
| 2018726 | 10/1979 | United Kingdom | 271/108 |

*Primary Examiner*—Kevin P. Shaver
*Assistant Examiner*—David H. Bollinger
*Attorney, Agent, or Firm*—Dennison, Meserole, Pollack & Scheiner

[57] ABSTRACT

A device for unstacking relatively flat objects such as letters or postal packets of various different lengths, widths, and thicknesses. The device includes: a conveyor for conveying stacks of objects as well as an object separating and grasping mechanism for separating and grasping the objects one-by-one, and a transport conveyor for transporting the objects one after another. The object separating and grasping mechanism has retainer and guide for retaining and guiding a stack of objects, for example a wall against which one of the edges of each object is pressed and object-grasping suction cup for engaging the first object of the stack as well as a displacement mechanism for displacing the cups initially in a first direction substantially perpendicular to the direction of stack advance and substantially parallel to the plane of the retainer and guide means, and then in a second direction which is substantially perpendicular to the movement of the first direction, in order to convey the object towards the transport conveyor.

10 Claims, 3 Drawing Sheets

DEVICE FOR UNSTACKING RELATIVELY FLAT OBJECTS SUCH AS LETTERS OR POSTAL PACKETS

The invention relates to a device for unstacking relatively flat objects such as letters or postal packets of various different lengths, widths, and thicknesses.

The invention is particularly applicable to mechanized or automated postal sorting.

BACKGROUND OF THE INVENTION

Ordinary postal packets or letters may be processed by installations operating at very high throughput in which stacks or rows of letters are brought up to devices which extract the letters constituting a stack one-by-one. However, such prior installations operate properly only if the postal packets or letters satisfy certain size conditions, and in particular conditions concerning thickness.

However, the postal services convey a very large variety of objects having unusual sizes and/or shapes.

The object of the invention is to provide a device enabling letters or postal packets of this type to be automatically unstacked.

Another object of the invention is to provide a device of this type capable of operating with relatively flat objects such as letters or postal packets whose sizes, and in particular whose thicknesses vary widely within a specified range.

SUMMARY OF THE INVENTION

To this end, the present invention provides a device for unstacking relatively flat objects such as letters or postal packets of various different lengths, widths, and thicknesses, the device comprising: a conveyor for conveying stacks of said objects; object separating and grasping means for separating and grasping the objects one-by-one; and a transport conveyor for transporting the object one after another; wherein the object separating and grasping means comprise stack retaining and guiding means for retaining and guiding a stack of objects, for example a wall against which one of the edges of each object is pressed; object-grasping means for engaging the first object of the stack; and displacement means for displacing the grasping means initially in a first direction substantially perpendicular to the direction of stack advance and substantially parallel to the plane of the retaining and guiding means, and then in a second direction which is substantially perpendicular to the two above-mentioned directions, in order to convey the object towards the transport conveyor.

By virtue of this arrangement, relatively flat objects having very different sizes can be separated from one another without the taking and displacing of the leading object causing a similar displacement of the following object in the stack.

Advantageously, the device includes means for accelerating the displacement of the object-grasping means in the first above-mentioned direction, which is preferably substantially vertical. The acceleration is advantageously applied in the plane of the flat object which thus withstands the forces well without running the risk of being damaged.

This displacement serves to take the object away from the stack retaining and guiding means. The displacement does not cause the following objects in the stack to be entrained since it takes place very quickly.

Thereafter, the displacement of the object in the second direction can take place at normal speed since any displacement in this second direction of the objects still in the stack is prevented by the stack retaining and guiding means.

Preferably, the grasping means are carried by a carriage which is displaceable in a plane perpendicular to the advance direction of the stack of objects, and which is guided parallel to the second above-specified direction, said object-grasping means being connected to said carriage by two articulated parallel arms, one of which carries a wheel which is guided along a curved running path.

The displacement trajectory of the grasping means and the speed of displacement along said trajectory are determined by the shape of the running path. Thus, an acceleration of the displacement of the grasping means over the first portion of their trajectory followed by displacement at a much lower speed, is ensured in a manner which is very simple, accurate, and cheap.

The grasping means preferably comprise at least one suction cup mounted at the end of a tube which is guided in translation in a support, and which is associated with a return spring constantly urging it towards the stack of objects.

In order to be able to accept objects of very different widths or lengths, the device preferably includes two of the above-specified suction cups, fed from independent sources of reduced pressure.

A device in accordance with the invention having the above-specified characteristics is capable, for example, of removing relatively flat objects one-by-one from a stack, with the lengths of the objects lying in the range 140 mm to 350 mm, with their heights varying over 90 mm to 250 mm, with their thicknesses varying over 0.6 mm to 20 mm, and with their weights varying over 20 grams (g) to 1,000 g, and with the objects being removed at a rate varying over the range 4,000 to 10,000 objects per hour.

BRIEF DESCRIPTION OF THE DRAWINGS

An embodiment of the invention is described by way of example with reference to the accompanying drawings, in which.

DESCRIPTION OF THE PREFERRED EMBODIMENT

Figure 1:
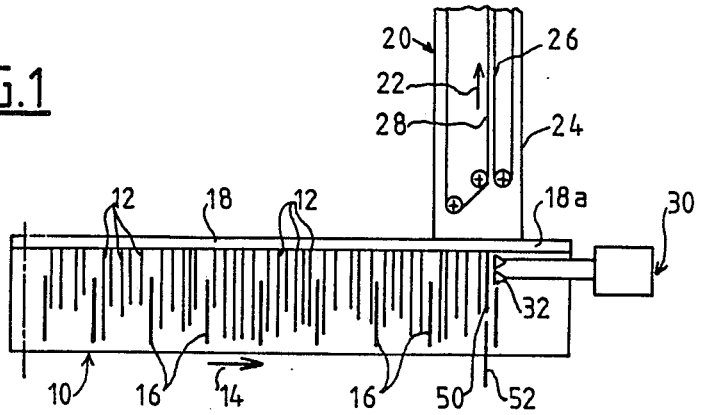
FIG. 1 is a diagrammatic plan view of a device in accordance with the invention.
Figure 2:
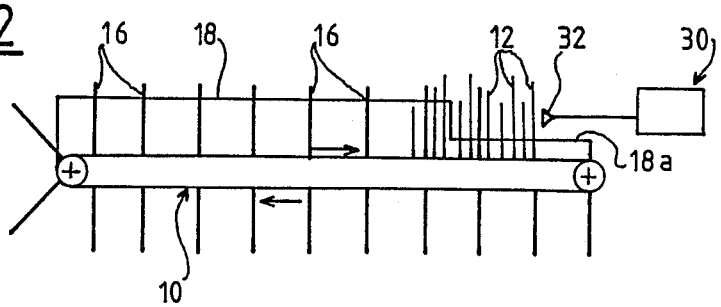
FIG. 2 is a diagrammatic side view of the device.

Reference is made initially to FIGS. 1 and 2 which show the general arrangement of a device for unstacking relatively flat objects in accordance with the invention.

This device firstly comprises a conveyor 10, for example of the notched-belt type carrying stacks or rows of relatively flat objects 12 such as letters or postal packages whose sizes lie outside current standards. The stacks of objects are disposed on the conveyor 10 which is substantially horizontal so that the objects 12 stand on edge and occupy vertical planes extending substantially perpendicularly to the direction of conveyor advance which is designated by arrow 14. In order to hold the objects 12 in this position, a band or notched belt forming a portion of the displacement surface of the conveyor 10 includes parallel separation plates 16 which extend perpendicularly to the direction 14 of conveyor displacement.

Stack guiding and retaining means for guiding and retaining the stacks of objects 12 placed on the conveyor 10 are provided along one side of the conveyor and are constituted, for example, by a substantially vertical wall 18 against which the stacks of objects 12 are pushed while they are being placed on the conveyor. At its leading end 18*a*, this side wall is of reduced height, e.g. about 30 mm. A second conveyor 20 runs from said leading end 18*a* for the purpose of transferring each object 12 one-by-one in a direction 22 which is substantially horizontal and perpendicular to the direction 14. This conveyor 20 includes an object support surface 24 which is level with the top edge of the leading end 18a of the side wall 18, together with object displacement means comprising, for example, two parallel bands 26 and 28 whose drive rolls extend perpendicularly to the surface 24. Each object 12 is thus clamped between the facing strands of the bands 26 and 28 and is displaced in the direction of arrow 22. In order to make it possible to adapt to objects 12 of different thicknesses, the band 28 facing the band 26 passes, for example, over a roll which is spring-biassed, thereby enabling it to move away from the band 26 in order to pass a thicker object 12.

The means for unstacking or grasping the objects 12 one-by-one are given a general reference 30, and are situated at the leading end of the conveyor 10 substantially level with the beginning of the second conveyor 20.

Figure 3:
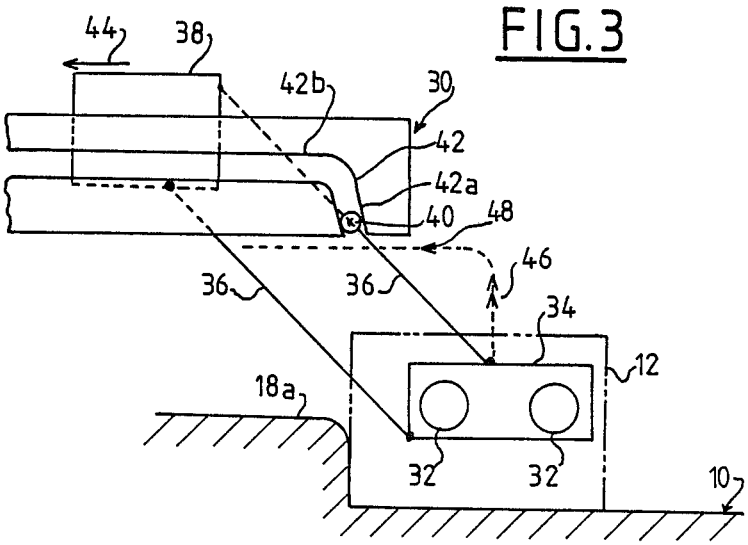
FIG. 3 is a diagrammatic view on a larger scale of object grasping means in accordance with the invention.

These means 30 which are shown in greater detail in FIG. 3 comprise a set of two suction cups 32 mounted on a support 34 which is connected by two parallel articulated arms 36 to a carriage 38 which is displaceable in reciprocating rectilinear motion parallel to the direction of displacement of the second conveyor 20. The carriage 38 is guided in rectilinear displacement by conventional means not shown and, for example, it is connected to a crank shaft by means of a connecting rod. One of the articulated arms 36 is fitted with a wheel or roll 40 guided in a running path 42 including a first portion 42*a* sloping at a small angle along a direction perpendicular to the above-specified directions 14 and 22, and a second portion 42*b* running parallel to the direction 22 of displacement of the second conveyor 20.

The suction cups 32 are connected under the control of an electrically controlled valve to two respective sources of reduced pressure which are independent from each other. When an object 12 is brought by the first conveyor 10 up to the suction cups 32, its surface is held by at least one of the suction cups. The displacement of the carriage in the direction indicated by arrow 44 in FIG. 3 initially has the effect of displacing the support 34 as shown by the arrow 46 in a substantially vertical direction, said displacement being very fast when the first portion 42*a* of the running path 42 is at an angle close to 90° relative to the second portion 42*b* of said running path, followed by displacement of the support 34 and of the object 12 as shown by arrow 48. The object 12 is thus snatched, i.e. extracted very quickly, from the stack of objects on the conveyor 10 and it is then displaced in the direction indicated by arrow 48 until it is taken by the second conveyor 20.

The first very rapid stage of displacement of the support 34 and the suction cups 32 in the direction of arrow 46 makes it possible to separate the objects 12 one-by-one from the stack carried by the conveyor 10 without causing the folllowing objects to be entrained. The second displacement stage in the direction of arrow 48 allows the object 12 as carried by the suction cups 32 to move over the retaining wall 18*a* and this takes place at a slower speed, which is substantially equal to the speed of displacement of the carriage 38. However, the following objects in the stack cannot be entrained in this direction since they are retained by the wall 18*a*.

When the object 12 carried by the suction cups 36 has been taken by the second conveyor 20, the carriage 38 is returned to its starting position as shown in FIG. 3 and the following object in the stack conveyed by the conveyor 10 may be grasped by the suction cups 32 and brought to the second conveyor 20.

Figure 4:
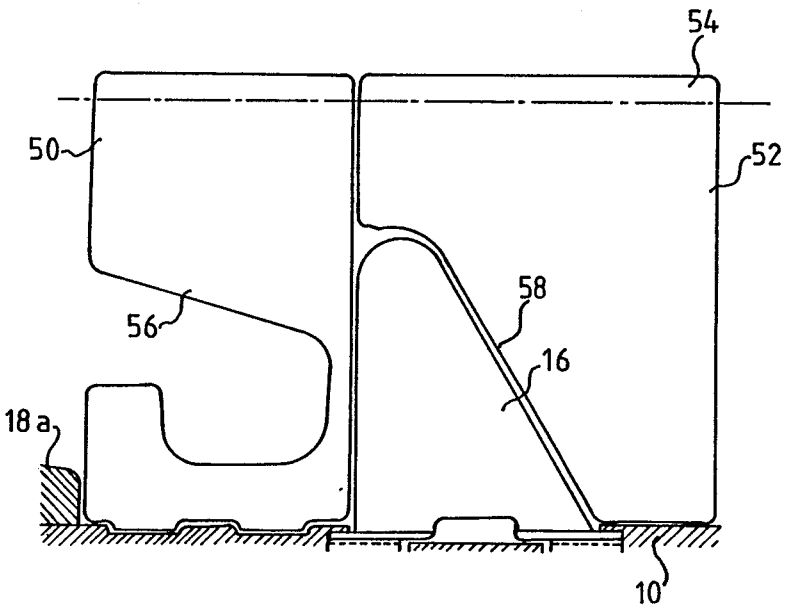
FIG. 4 shows, on a larger scale, regulation and safety means with which the device is fitted.

Regulation and safety means are also provided at the junction between the two conveyors. These means comprise, for example, two flaps 50 and 52 disposed across the first conveyor 10 and having top edges which are hinged about a common axis 54 parallel to the above-specified direction 22. These flaps 50 and 52 are interposed between the stacks of objects 12 carried by the conveyor 10 and the means 30 for grasping the objects one-by-one. The flap 50 thus includes a cut-out 56 having the shape shown in FIG. 4 for allowing the suction cups 32 of the means 30 to pass therethrough and to move therein, whereas the flap 52 includes a cut-out 58 allowing the separation plates 16 of the conveyor 10 to pass therethrough.

Operation is as follows:

When a stack of objects 12 carried by the conveyor 10 is advanced towards the grasping means 30, each object is normally grasped by the suction cups 32 immediately before said object reaches the flap 50. If, for any reason, an object 12 comes into abutment against the flap 50 and displaces it over a predetermined distance, e.g. about 5 mm, said displacement operates a switch which causes the conveyor 10 to stop. If the flap 50 is moved a greater distance, e.g. 10 mm, another switch causes a security or emergency stop to take place.

The flap 52 is used solely as a safety member for stopping the device when it has been displaced through a predetermined distance. The flaps 50 and 52 thereby guarantee the safety of an operator who may occasionally be caused to put a hand into the vicinity of the object-grasping means.

Figure 5:
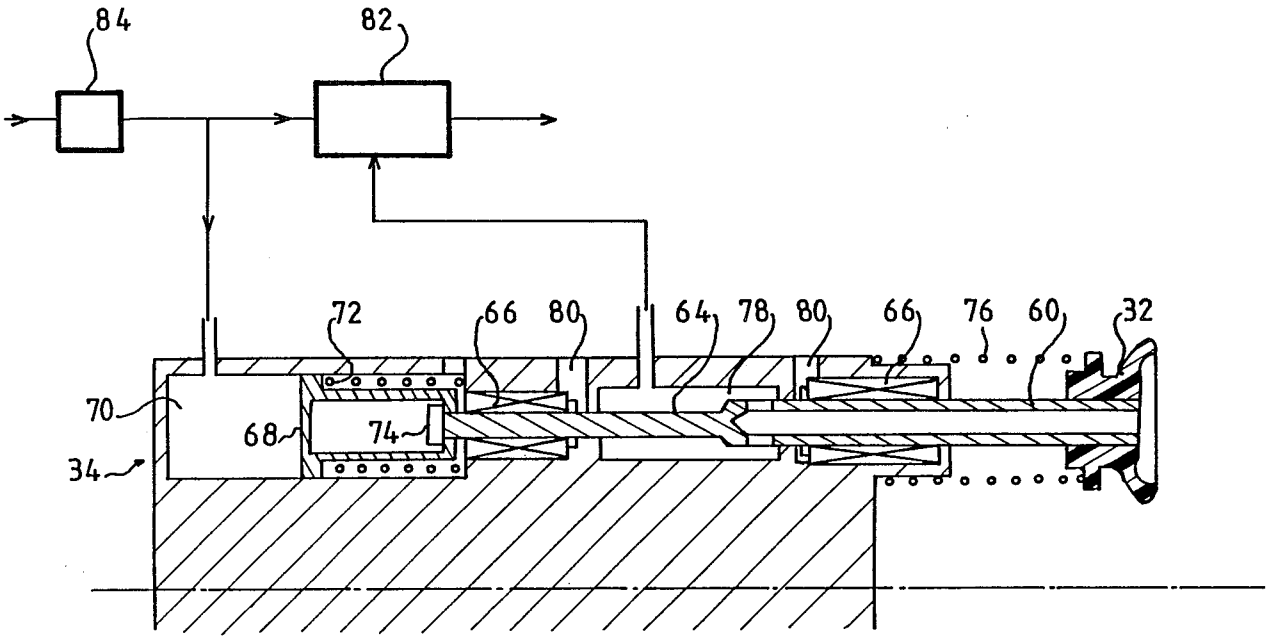
FIG. 5 is an axial section through an object grasping means in accordance with the preferred embodiment of the invention.

Reference is now made to FIG. 5 which shows a preferred embodiment of the object-grasping means in detail.

In this embodiment, each suction cup 32 is mounted at the end of a tube 60 which terminates at its opposite end in the form of a smaller diameter cylindrical rod 64. The tube 60 and the rod 64 are guided in reciprocating rectilinear motion in the support 34 by means of ball sleeves in order to reduce friction. The free end of the cylindrical rod 64 is associated with a piston 68 mounted in a cylindrical chamber 70 of the support 34 and associated with a compression spring 72 such that when the chamber 70 is fed with gas under pressure, the piston 68 is displaced to the right and compresses the spring 72, and when the chamber 70 is connected to exhaust, the spring 72 returns the piston to the lefthand end of the chamber 70. The cylindrical rod 64 is mounted free to move in translation relative to the piston 68 by means of an opening in the end of the piston, and it includes a head 74 of diameter greater than the diameter of the hole, thus constituting a retaining member. At the opposite end, the tube 60 is also associated with a compression spring 76 which permanently urges it to the right in FIG. 5 and which thus opposes the action of the spring 72 but with a smaller force. The junction between the cylindrical rod 64 and the tube 60 lies in a chamber 78 formed in the support 34 and connected to a source of reduced pressure. Radial orifices formed through the wall of the tube 60 provide communication between the inside of the tube and the chamber 78.

These means operate as follows:

When the chamber 70 is connected to exhaust, the spring 72 urges the piston 68 to the lefthand side of said chamber as shown in FIG. 5. The head 74 comes into abutment against the bottom of the piston 68 and the rod 64 and the tube 60 carrying the suction cup 32 follow the movement of the piston, thereby compressing the spring 76 whose force is less than the force of the spring 70. The suction cup 32 is thus in a retracted or rest position.

An electrically controlled valve allows the chamber 70 to be supplied with gas under pressure. Simultaneously, said valve causes the chamber 78 to be connected to reduced pressure. The piston 68 is thus displaced to the right in FIG. 5, thereby compressing its spring 72, and the rod 64 and the tube 60 carrying the suction cup 32 are moved to their righthand extreme position by virtue of the spring 76 expanding. The reduced pressure occupying the chamber 78 gives rise to continuous suction inside the suction cup 32 and the tube 60. When the surface of an object 12 engages the suction cup 32, the pressure inside the tube 60 and the chamber 78 drops. Because of the difference in cross-section between the rod 64 and the tube 60 inside the chamber 78, this reduced pressure tends to urge the tube 60 and the rod 64 to the left in approximate equilibrium with the rightwards displacement force developed by the spring 76. The suction cup 32 and its tube 60 are thus floatingly mounted relative to the support 34. As a result, each object-grasping means adapts automatically to the thickness of an object to be grasped, and the following objects in the stack are not pressed against each other when the leading object of the stack is grasped. Further, the two suction cups 32 of the object-grasping means 30 are independent from each other both in their positions relative to the common support 34 and in their supply of suction or reduced pressure, thereby making it possible to grasp objects effectively even if they have irregular surfaces.

It will be observed that vent holes 80 are formed in the support 34 level with the ball sleeves 66 at either end of the suction chamber 78. Since the rod 64 and the tube 70 are not perfectly sealed where they pass through the walls of the chamber 78, the presence of these vent holes 80 serves to prevent dust and other dirt being sucked into the ball sleeves.

Preferably, each source of reduced pressure is formed by an ejector nozzle 82 which is fed with the same gas under pressure as the chamber 70 under the control of an electrically controlled valve 84.

I claim:

1. A device for unstacking relatively flat objects such as letters and postal packets of various different lengths, widths and thicknesses, the device comprising:

a first conveyor for conveying a stack of said objects in a direction along stack guiding means having a wall against which an edge of each object is pressed, a second conveyor for transporting the objects one-by-one in a direction perpendicular to the direction of the first conveyor, grasping means for engaging the first object on the stack on the first conveyor, and displacing means for displacing the grasping means in a first direction substantially perpendicular to the direction of the first and second conveyors and then in a second direction substantially parallel to the direction of the second conveyor, wherein said displacing means includes a carriage, means for guiding the carriage in a direction substantially parallel to that of the second conveyor, two articulated parallel arms connecting the carriage to the grasping means, and a wheel carried by one of said arms and guided along a curved running path.

2. A device according to claim 1, wherein the displacement of the object-grasping means is accelerated in the first above-mentioned direction.

3. A device according to claim 1, including plates or flaps pivotally mounted about an axis perpendicular to the direction of stack advance and level with the object separating and grasping means in order to serve as advance regulating and safety members.

4. A device according to claim 3, wherein one of the flaps includes a cut-out for allowing the object-grasping means to pass therethrough.

5. A device according to claim 1, wherein the said running path comprises a first part slightly sloping along the first direction, and a second part substantially parallel to the second direction.

6. A device according to claim 1, wherein the wall of the stack guiding means has a portion of reduced height at the vicinity of the grasping means, and the grasping means move over this portion when they are displaced in the second direction.

7. A device according to claim 1, wherein the grasping means comprise at least one suction cup mounted on a tube which is movable in a direction parallel to that of the first conveyor.

8. A device according to claim 7, wherein the grasping means comprise a support member, the tube being guided in translation in said support member and being associated with a return spring constantly urging it towards the stack of objects.

9. A device according to claim 8, wherein the support comprises a chamber connected to a source of reduced pressure and having the suction cup carrying tube passing therethrough, said tube including a portion of reduced diameter extending inside said chamber such that the establishment of reduced pressure inside the chamber, the tube, and the suction cup tends to produce displacement of the tube in a direction opposite to that due to the action of the return spring and in approximate equilibrium with the action of the return spring.

10. A device according to claim 9, wherein the object-grasping means comprise two suction cups fed from independent sources of reduced pressure.

* * * * *